United States Patent [19]

McDonald, deceased et al.

[11] 4,134,600

[45] Jan. 16, 1979

[54] ROLLER SKI APPARATUS WITH SPRING SUSPENSION

[76] Inventors: Benjamin J. McDonald, deceased, late of Canyon Country, Calif., by Dorothy H. McDonald, administratrix, 27604 Sand Canyon Rd., Canyon Country, Calif. 91351

[21] Appl. No.: 790,443

[22] Filed: Apr. 25, 1977

[51] Int. Cl.[2] ..... A63C 17/26; A63C 1/28

[52] U.S. Cl. ..... 280/87.04 A; 280/11.1 BT; 280/11.28

[58] Field of Search ..... 280/87.04 A, 87.04 R, 280/11.1 BT, 11.28, 11.27, 11.26, 11.22, 11.19, 11.1 R

[56] References Cited

U.S. PATENT DOCUMENTS

| | | | |
|---|---|---|---|
| 1,632,997 | 6/1927 | Connolly | 280/11.19 |
| 2,366,866 | 1/1945 | Moller | 280/87.04 R |
| 2,474,082 | 6/1949 | Wutz | 280/11.19 |
| 3,023,022 | 2/1962 | Boyden | 280/87.04 R |
| 3,399,904 | 9/1968 | Schinke | 280/87.04 A |
| 3,436,088 | 4/1969 | Kunselman | 280/87.04 A X |
| 3,684,305 | 8/1972 | McDonald et al. | 280/87.04 A X |
| 3,856,321 | 12/1974 | Solymosi | 280/87.04 A |
| 3,891,225 | 6/1975 | Sessa | 280/87.04 R X |

FOREIGN PATENT DOCUMENTS 2150912 4/1973 Fed. Rep. of Germany ... 280/11.1 BT

*Primary Examiner*—Joseph F. Peters, Jr.
*Assistant Examiner*—Milton L. Smith
*Attorney, Agent, or Firm*—Sellers and Brace

[57] ABSTRACT

Roller ski apparatus for supporting a rider on pavement or the like comprising a foot-supporting platform equipped at its opposite ends with skate-type wheel units and a resilient suspension device. The suspension device provides the rider with a smooth glide-like ride closely simulating that experienced in skiing on snow. Control handles pivotally connected to the sides of the platform aid the rider in maintaining balance and in shifting his weight to activate the steering capabilities of the wheel units which have limited swiveling properties. One embodiment includes separate foot-supporting members supported on a common frame for independently pivotable movement about their own longitudinal axis and spring biased to a neutral coplaner position. The apparatus may comprise a single foot-supporting platform or a separate platform for each foot, but each construction embodies a spring suspension for the rearmost wheel unit.

12 Claims, 4 Drawing Figures

3
4

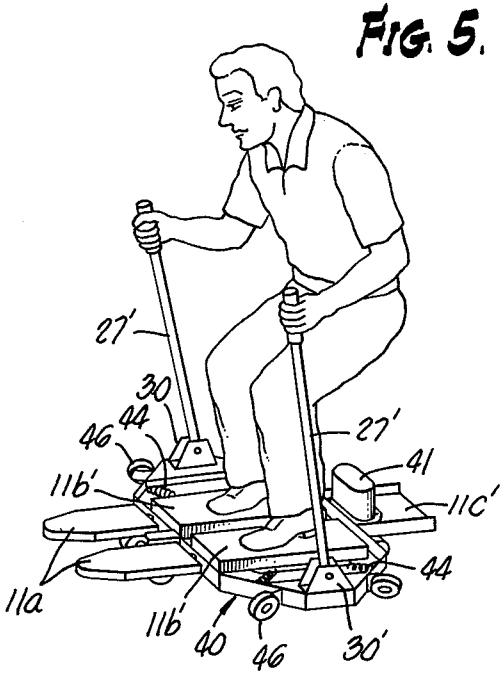
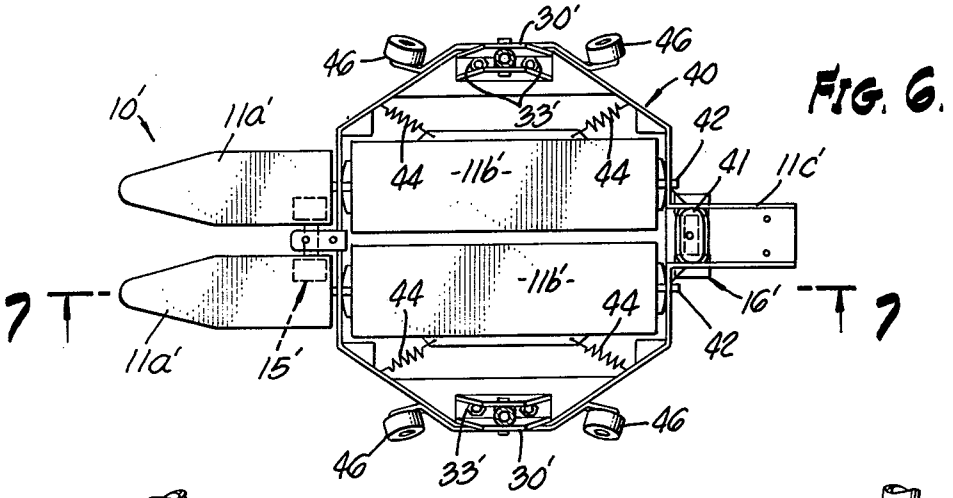
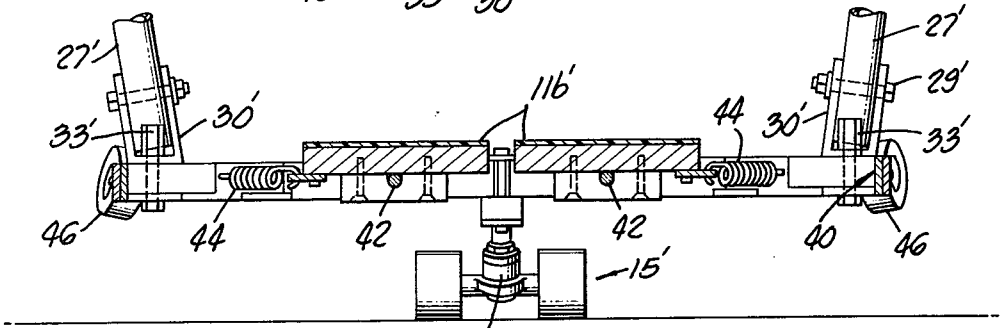
FIG. 8.
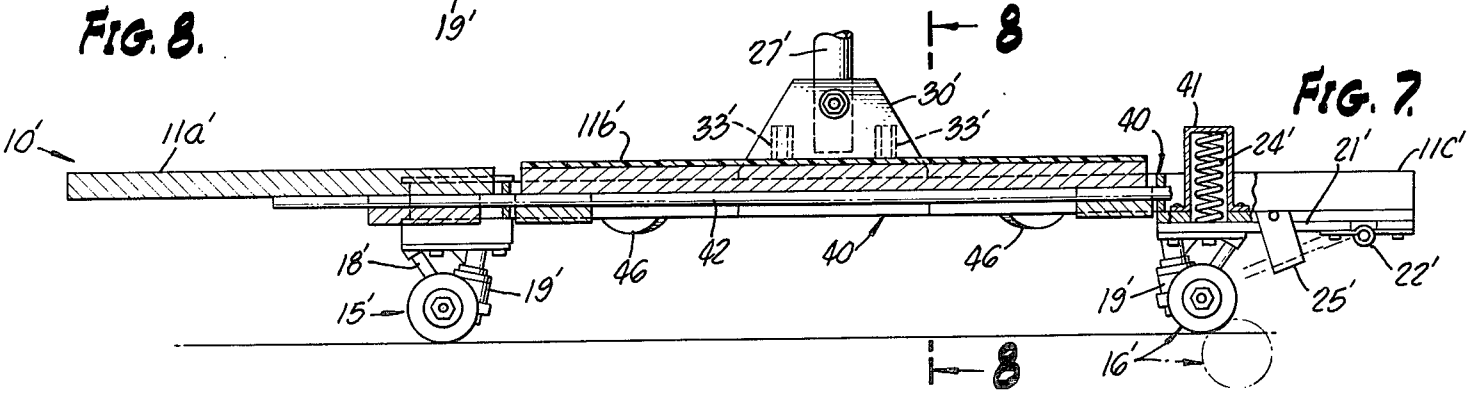

ROLLER SKI APPARATUS WITH SPRING SUSPENSION

This invention relates to athletic equipment and more particularly to an improved and novel roller ski equipped with skate-type wheel units some of which embody suspension means, the ski being usable on dry pavements and closely approximating the characteristics and maneuverability of snow skis.

Proposals have been made heretofore for athletic and amusement equipment enabling one to enjoy the sport of skiing without need for snow or the like or a specially constructed skiing surface. These proposals, in general, provide rider-supporting members mounted on rollers for use on inclined surfaces. Typical dry-land roller skiing apparatus as heretofore proposed are disclosed in Schinke U.S. Pat. No. 3,399,904, Boyden U.S. Pat. No. 3,023,022, Kunselman U.S. Pat. No. 3,436,088, and McDonald et al. U.S. Pat. No. 3,684,305. Each of these prior constructions and others of a more remote construction fail to provide the rider with a smooth gliding ride owing to the lack of any means for absorbing shocks and jolts encountered by the rollers passing over irregular surfaces. Because of this shortcoming, the rider is likely to lose control, balance, and bodily stability thereby interfering with his safety and pleasure. The aforementioned earlier patent granted to the present applicants greatly minimizes the foregoing characteristics of prior dry-land skiing devices by virtue of the use of control handles projecting upwardly from the opposite sides of the support platform and additionally by the presence of laterally disposed tilt-limiting rollers.

The foregoing and other deficiencies of prior roller ski equipment are avoided by the present invention which embodies resilient suspension means for certain of the supporting wheels and particularly the rearmost wheel units as well as other improvements. In one embodiment of the improved ski apparatus, separate platform supports are provided for each of the rider's feet and each is equipped with a control handle pivotally connected to an outrigger projecting outwardly from the forward end and generally opposite the forward skate-type wheel unit. This disposition of the control handles provides the rider with more effective steering control and facilitates deep bending of the knees when negotiating turns and changes of direction.

A second embodiment of the invention is of a more sophisticated design suitable for use by experienced roller skiers and utilizes a single pair of skate-type rollers located at spaced apart points along the longitudinal axis of a single unitary rider support platform. The latter has a main frame provided with separate foot supports independently pivotable about their respective longitudinal axes. These separate supports are normally spring-biased to a common coplanar position but are tiltable in unison or independently of one another under the control of the rider. The rearmost wheel unit embodies a resilient suspension device providing the rider with a smooth gliding ride over rough surfaces. Guidance, balance, and control of the apparatus are further facilitated by the use of control handles pivoted to the opposite sides of the rigid main frame on outriggers forming part of that frame.

Accordingly, it is a primary object of the invention to provide an improved and unique roller ski apparatus supported on forward and rear skate-type wheel units and incorporating a resilient suspension means therefor.

Another object of the invention is the provision of improved roller ski apparatus employing a pair of independent foot-supporting platforms each mounted on forward and rear skate-type wheel units and including a resilient suspension means.

Another object of the invention is the provision of a pair of independent foot-supporting roller ski platforms each mounted on resilient suspension rollers and each equipped with a control handle pivotally connected to an outrigger from the outer side of the foot support.

Another object of the invention is the provision of roller ski apparatus having a single rider supporting platform mounted on a single pair of skate-type wheel units and utilizing separate foot supports each pivotable about the longitudinal axis thereof and spring-biased to a neutral position.

Another object of the invention is the provision of a roller ski apparatus having a rider supporting platform mounted on a pair of skate-type wheel units the rear one of which is equipped with spring suspension means.

These and other more specific objects will appear upon reading the following specification and claims and upon considering in connection therewith the attached drawings to which they relate.

Referring now to the drawings in which a preferred embodiment of the invention is illustrated:

FIG. 5 is a view similar to FIG. 1 but showing a second preferred embodiment of the invention in use;

FIG. 6 is a plan view of FIG. 5 on an enlarged scale with the control handles broken away;

FIG. 7 is a longitudinal cross-sectional view taken along line 7—7 on FIG. 6; and FIG. 8 is a cross-sectional view taken along line 8—8 on FIG. 7.

Figures 1, 2, 3, 4:
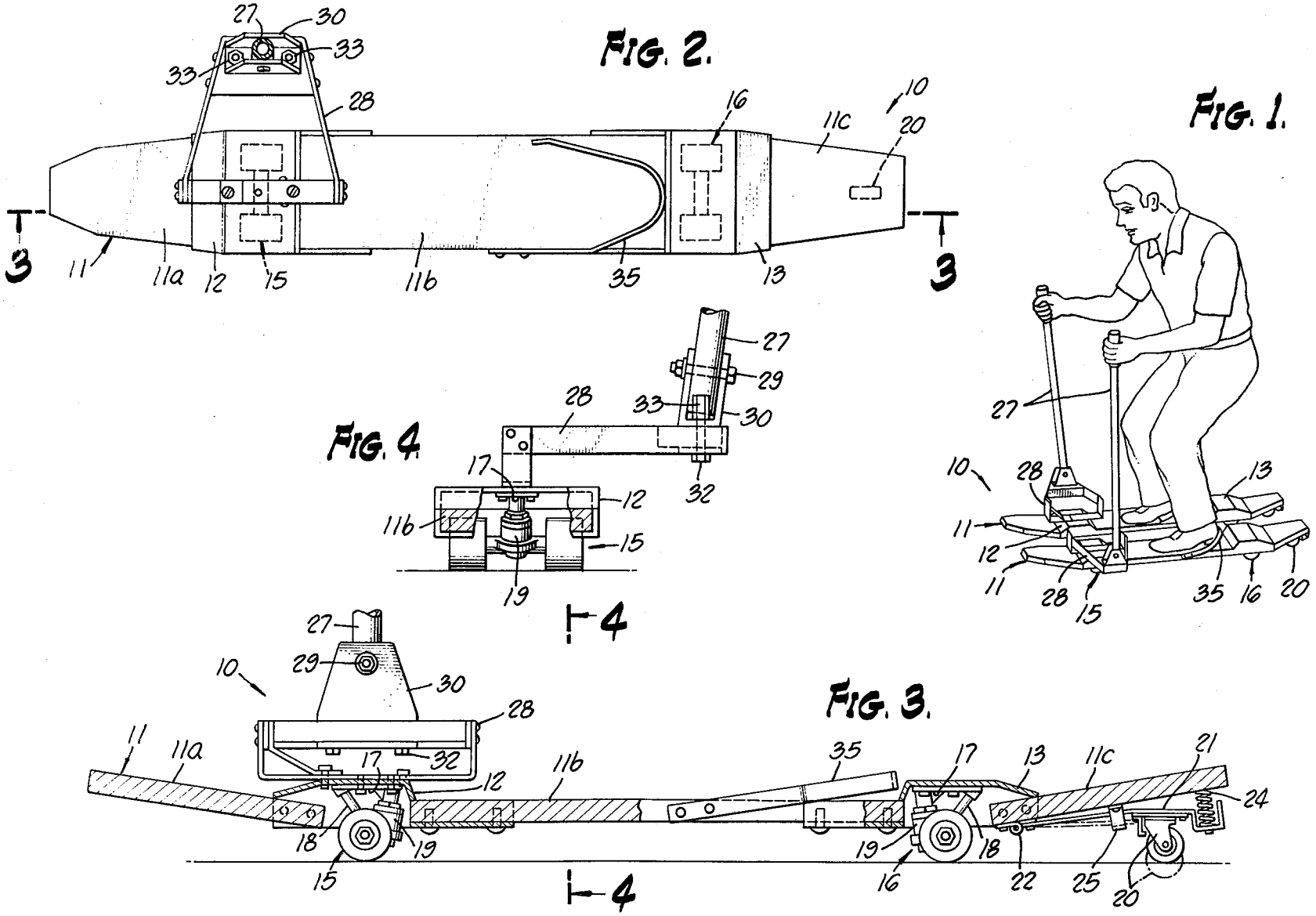
FIG. 1 is a perspective view showing a first preferred embodiment of the invention in use to support a rider.
FIG. 2 is a plan view of the FIG. 1 roller ski on an enlarged scale with the control handle in cross-section.
FIG. 3 is a longitudinal sectional view taken along line 3—3 on FIG. 2.
FIG. 4 is a fragmentary cross-sectional view taken along line 4—4 on FIG. 3.

Referring to FIGS. 1–4, there is shown a first illustrative embodiment of the invention, designated generally 10, comprising a pair of generally similar structurally independent foot-supporting platforms 11, 11 for a separate one of the rider's feet. These platforms differ from one another only in that the control handles are mounted on outrigger devices projecting from opposite sides of the forward end portions of each platform. Accordingly, a detailed description of one platform 11 will suffice.

The main body of the roller ski comprises an elongated platform of any suitable rigid material and includes three sections 11*a*, 11*b*, and 11*c* rigidly connected in spaced apart relation by generally inverted cup-shaped connectors 12 and 13. These connectors provide downwardly opening shallow wells sized to accommodate conventional skate-type wheel units 15, 16. Preferably the wheel units are of a well known type employing wide roller bearing wheels mounted on the opposite ends of an axle and movably connected to a mounting plate 17 rigidly secured to the bottom of connectors 12, 13 in the manner best shown in FIG. 3. The midportion of the wheel axle is rigidly fixed to an inclined strut 18 having its upper end movably socketed in the mounting plate 17. A second upwardly supporting strut from the axle unit includes a long cylindrical rubber ring 19 which cooperates with the pivoted end of strut 18 to permit limited swiveling movement of the associated pair of rollers and is responsive in a manner well known to those skilled in the roller skating art to steer the roller skate unit in response to a shift in the weight of the rider. Normally, the rubber cylinders 19 maintain the axis of the rollers perpendicular to the longitudinal axis of the foot-supporting platform. However, if the rider shifts his weight the wheel units tilt and rotate slightly clockwise or counterclockwise as viewed in FIG. 2 to steer the apparatus along a desired curvilinear path.

As herein shown, a resilient suspension for the rear end of the apparatus comprises a castering rear wheel unit 20 suitably fixed to the rear end of a supporting plate 21 having its forward end hinged at 22 to the rear platform member 11*c*. Wheel 20 and its supporting plate 21 are urged to hinge or pivot downwardly by one or more strong compression springs 24 interposed between the rear end of this plate and the overlying portion of platform member 11*c*. A U-shaped strip 25 embracing mounting plate 21 limits the downward or clockwise pivoting of wheel 20 when the apparatus is not in use. It will be understood that the spring or springs 24 are sufficiently strong to support the rear end of the roller ski and the rider in an intermediate slightly compressed condition of spring 24. If the rider is not present, the roller ski board will be supported by the front pair of rollers 15 and by the rear wheel 20 of the spring suspension unit.

To aid the rider in balancing himself and in maneuvering the ski apparatus, each of the foot-supporting platforms is preferably provided with a control handle 27 having its lower end pivotably connected to an outrigger bracket 28 rigidly secured to the forward end of the platform and projecting outwardly from the side thereof. As herein shown, outriggers 28 are rigidly secured to the forward connector 12.

The lower ends of control handles 27 are pivotally connected by a bolt 29 to a U-shaped bracket 30 fixed to the outer end of outrigger 28. Brackets 30 are secured to the outrigger by a pair of bolts 32 having clamping nuts 33 at their upper ends additionally serving as stops engageable with the lower ends of control handles 27 to limit the forward and rearward pivoting movement of these handles. Brackets 30 do not permit movement of the control handles crosswise of the platforms 11 but do permit small arc forward and rearward movement to the extent permitted by the stop nuts 33, 33.

An additional feature of the apparatus is the provision of a U-shaped foot-locating member 35 which embraces the heel of the rider when his foot is properly positioned on the platform 11. The forward ends of the legs of member 35 are suitably secured to the opposite sides of the central platform member 11*b*.

A second embodiment of the roller ski apparatus is illustrated in FIGS. 5 to 8 and those features common to the two embodiments will be identified by the same reference character distinguished by the addition of a prime. Roller ski apparatus 10' is a unitary assembly having a rigid generally octagonal ring-like main frame 40 supported on its forward side by skate-type wheel units 15' and at its rearward side by a similar skate-type wheel unit 16' both mounted along the longitudinal center line of the main body. The rear wheel unit 16' is rigidly secured to a plate 21' hinged to the rear underside of member 11c by a hinge 22'. Plate 21' and the wheel unit 16' mounted thereon are equipped with resilient suspension means comprising one and preferably two powerful compression springs 24' having their lower ends bearing against the upper forward end of plate 21' and their upper ends bearing against the bottom of an inverted cup-shaped housing 41 rigidly fixed to platform member 11*c'*. Downward pivotal movement of wheel unit 16' is limited by a U-shaped stop 25' secured to platform member 11*c'* and similar in purpose to the corresponding stop member 25 in the first embodiment.

When a rider is not present on apparatus 10', the wheels of unit 16' are in their extended dot-and-dash line position shown in FIG. 7. When a rider is present, the wheels of unit 16' are in an intermediate position between the dot-and-dash line and the fully collapsed position shown in full line. Accordingly, the full-line showing represents the extreme fully collapsed position of the wheels which is seldom experienced in actual use of apparatus 10'.

An important feature of the second embodiment is the fact that the two foot-supporting platform members 11*b'* are spaced closely parallel to one another and their opposite ends are pivotally connected to the frame 40 by separate shafts 42, 42. These shafts are secured to members 11*b'* along the longitudinal center line of members 11*b'*. As appears most clearly from FIG. 5, platform members 11*b'* support the rider's feet generally centralized above shafts 42.

Normally, members 11*b'* are held in the coplanar position shown in FIGS. 5 and 8 by strong tension springs 44, 44. These springs are attached to the outer sides and near the opposite ends of the two foot-supporting members and the outer ends of the springs are connected to the main frame 40. It will therefore be clear that members 11*b'* can pivot in either a clockwise or counterclockwise direction about the centers of shaft 42 but, in so doing, additionally stress the already stressed springs 44.

Tilt control rollers 46 to limit extreme tilting of the ski apparatus are mounted in pairs along either outer side of frame 40. Normally, of course, the rollers 46 are located well above ground level but serve to prevent contact of frame 40 with the ground in more extreme tilting positions of the ski apparatus.

The control handles 27' are mounted on outrigger portions of frame 40 and comprising those portions which project laterally beyond the opposite sides of platform members 11*b'*. The construction, purpose, and mode of use of these controls are the same as those described above in connection with FIGS. 1 to 4.

The mode of use of the two embodiments of the invention will be apparent from the foregoing detailed description of the structure. In the first embodiment, the rider positions the two roller ski units beside one another and places his foot on the center member 11*b* of a first one of the roller skis. At the same time, he grasps the handgrips of the two control handles 27 and uses the free foot to push or pump the first ski unit forward as one hand and one control handle are employed to keep the second ski unit in forward movement. The two units being underway on a suitable surface, the rider rests his pumping foot on the second unit and glides forwardly under increasing speed. The two handles are then manipulated and additional manipulative effort is exercised by shifting his body weight as required to steer the skatelike wheel units 15 and 16 supporting each roller ski unit. The rearward swiveling wheel unit 20 together with its resilient suspension spring 24 aids in providing a smooth resilient ride for the rider and swivels as necessary to follow the general path of travel controlled primarily by the two steerable wheel units 15 and 16.

The second embodiment shown in FIGS. 5 to 8 functions generally similarly to that described above for the FIGS. 1 to 4 embodiment except that the rider is supported on a single pair of steerable skatelike wheel units 15', 16' and therefore has no need for exercising care to maintain a pair of separate roller ski units traveling in unison with one another. He exercises directional control of the apparatus, in part, by manipulating the control handles 27' and, in part, by shifting his weight to tilt the main frame and additionally by applying directional control by shifting his weight and by tilting the individual platform members 11b'.

While the particular roller ski apparatus with spring suspension herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

We claim:

1. Roller ski apparatus comprising: elongated foot-supporting platform means, a plurality of supporting wheels movably secured to each end of said platform means along the longitudinal axis and adjacent the opposite end portions thereof and including a plurality of skate-type roller wheels having limited steering capability in response to a shift of the rider's weight crosswise of said ski apparatus, spring means interposed between said platform means and at least the wheels supporting the rear ends thereof thereby biasing said rear wheels away from the underside of said platform means about a pivot axis extending crosswise of said platform means and effective to simulate the bounce experienced in snow skiing as a rider using said ski apparatus rolls along an uneven surface, bracket means secured to and projecting outwardly from the opposite lateral sides of said platform means, and a control handle extending upwardly from the outer end of each of said bracket means to a convenient height for grasping by the rider's hand, said control handle means having limited freedom of movement in a vertical plane extending generally parallel to the longitudinal axis of said platform means and manipulatable by the rider to control lateral banking tilt of said platform means while changing the travel direction thereof.

2. Roller ski apparatus as defined in claim 1 wherein said spring-biased wheel includes means providing a generally upright pivot axis therefor located slightly forwardly of the rotational axis of the wheel whereby said wheel can swivel to facilitate steering movement of said ski apparatus as the rider shifts his weight to one side or the other of his path of travel.

3. Roller ski apparatus as defined in claim 1 wherein said pivotally supported wheels are secured to said platform means by hinge means having its hinge axis extending crosswise of said platform means to form said crosswise extending pivot axis.

4. Roller ski apparatus as defined in claim 1 wherein said skate-type wheels are mounted in well-like recesses opening downwardly from the underside of said platform means.

5. Roller ski apparatus as defined in claim 1 wherein said platform means is provided with means upstanding therefrom and shaped to embrace, seat and position the heel of the rider's foot when supported thereon.

6. Roller ski apparatus as defined in claim 1 wherein said bracket means is positioned generally laterally opposite the forward one of said skate-type wheels.

7. Roller ski apparatus comprising:

foot-supporting platform means including a rigid frame pivotally supporting the opposite ends of a pair of elongated foot-supporting members arranged side by side longitudinally of said ski apparatus, a skate-type wheel unit secured to the opposite ends of said rigid frame on the longitudinal axis of said ski apparatus which axis is spaced midway between and parallel to the pivot axes of said foot-supporting members, and spring means biasing said foot-supporting members to a neutral coplanar position.

8. Roller ski apparatus as defined in claim 7 including hinge means having an axis extending crosswise of said foot-supporting means pivotally connecting one of said skate-type wheel units to said rigid frame, and spring means urging said one wheel unit to pivot away from the bottom of said ski apparatus and effective to support a rider resiliently and to simulate the bounce experienced in snow skiing over undulating and uneven snow surfaces.

9. Roller ski apparatus as defined in claim 7 including spring means between said rigid frame and at least one of said wheel units and effective to provide a support for a rider using said ski apparatus.

10. Roller ski apparatus as defined in claim 9 including of a pair of control handles pivotally secured to the opposite lateral sides of said rigid frame and including means permitting said control handles to move through a limited arc longitudinally of said ski apparatus.

11. Roller ski apparatus as defined in claim 7 including outrigger tilt control means mounted on the opposite lateral sides of said rigid frame at a level normally spaced above the ground and effective to limit sidewise tilt of said ski apparatus.

12. Roller ski apparatus as defined in claim 11 wherein said tilt control means comprises wheels secured to the lateral sides of said rigid frame outwardly of the adjacent one of said pivoting foot-supporting members.

* * * * *